US010583675B2

(12) United States Patent
Portela Mata et al.

(10) Patent No.: US 10,583,675 B2
(45) Date of Patent: Mar. 10, 2020

(54) PRINTER VAPOR CONTROL

(71) Applicant: HEWLETT-PACKARD DEVELOPMENT COMPANY, L.P., Houston, TX (US)

(72) Inventors: Laura Portela Mata, Sant Cugat del Valles (ES); Adrian Liga Gondawijaya, Barcelona (ES); Carlos Lahoz Buch, Cerdanyola (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 1765 days.

(21) Appl. No.: 13/726,345

(22) Filed: Dec. 24, 2012

(65) Prior Publication Data

US 2014/0176635 A1 Jun. 26, 2014

(51) Int. Cl.
*B41J 29/377* (2006.01)
*B41J 11/00* (2006.01)

(52) U.S. Cl.
CPC ..... *B41J 29/377* (2013.01); *B41J 11/002* (2013.01)

(58) Field of Classification Search
USPC ..... 347/36, 39
See application file for complete search history.

(56) References Cited

U.S. PATENT DOCUMENTS 5,089,830 A * 2/1992 Cha ..... B41J 29/377 346/25
5,296,873 A * 3/1994 Russell et al. ..... 346/25
6,340,225 B1 * 1/2002 Szlucha ..... 347/102
6,390,618 B1 * 5/2002 Wotton et al. ..... 347/102
6,419,334 B1 * 7/2002 Akuzawa et al. ..... 347/8
6,477,347 B2 * 11/2002 Yokota ..... G03G 15/5008 399/250
6,643,220 B2 * 11/2003 Anderson ..... B41J 2/17 347/18
7,131,722 B2 * 11/2006 Yoneyama ..... B41J 11/002 347/101
7,354,142 B2 * 4/2008 DeVore ..... B41J 2/125 347/83
7,690,776 B2 * 4/2010 DeVore ..... B41J 2/125 347/92
8,511,793 B2 * 8/2013 Yokota ..... B41J 2/16538 347/21
8,770,714 B2 * 7/2014 Krichtman et al. ..... 347/35
8,833,925 B2 * 9/2014 Bradley ..... B41J 11/002 347/102
9,010,892 B2 * 4/2015 Frydman ..... B41J 29/377 347/102
2001/0026696 A1 * 10/2001 Yokota ..... G03G 15/5008 399/57
2004/0041892 A1 * 3/2004 Yoneyama ..... B41J 11/002 347/102
2006/0119670 A1 * 6/2006 DeVore ..... B41J 2/125 347/83
2008/0100647 A1 * 5/2008 DeVore ..... B41J 2/19 347/6

(Continued)

*Primary Examiner* — Henok D Legesse

(74) *Attorney, Agent, or Firm* — HP Inc. Patent Department

(57) ABSTRACT

Examples systems and methods of this disclosure include a threshold corresponding to a vapor density, and a circuit or method step to compare an incoming signal that corresponds to a detected vapor density with the threshold.

12 Claims, 5 Drawing Sheets

(56) References Cited

U.S. PATENT DOCUMENTS

| | | | | |
|---|---|---|---|---|
| 2009/0290897 | A1* | 11/2009 | Doshoda | G03G 21/206 399/93 |
| 2013/0083115 | A1* | 4/2013 | Kasiske, Jr. | B41J 11/002 347/17 |
| 2013/0293620 | A1* | 11/2013 | Tunmore et al. | 347/17 |
| 2014/0125719 | A1* | 5/2014 | Frydman | B41J 29/377 347/7 |
| 2014/0176635 | A1* | 6/2014 | Portela Mata | B41J 11/002 347/19 |
| 2014/0176654 | A1* | 6/2014 | Hawryschuk et al. | 347/102 |

* cited by examiner

PRINTER VAPOR CONTROL

BACKGROUND

Certain inks release vapor during printing or curing. For example water based inks release vapor. If high amounts of vapor are released, the vapor may become visible to the end user, and in certain events condense onto the printer or surrounding objects.

BRIEF DESCRIPTION OF THE DRAWINGS

For the purpose of illustration, certain examples constructed in accordance with the teachings of this disclosure will now be described with reference to the accompanying drawings, in which.

DETAILED DESCRIPTION

In the following detailed description, reference is made to the accompanying drawings. The examples in the description and drawings should be considered illustrative and are not to be considered as limiting to the specific example or element described. Multiple examples may be derived from the following description and/or drawings through modification, combination or variation of certain elements. Although certain features are shown and described in conjunction they may be applied separately to the ink tank of this description, also if not specifically claimed. Furthermore, it may be understood that examples or elements that are not literally described may be derived from the description and drawings by a person of ordinary skill in the art.

Figure 1:
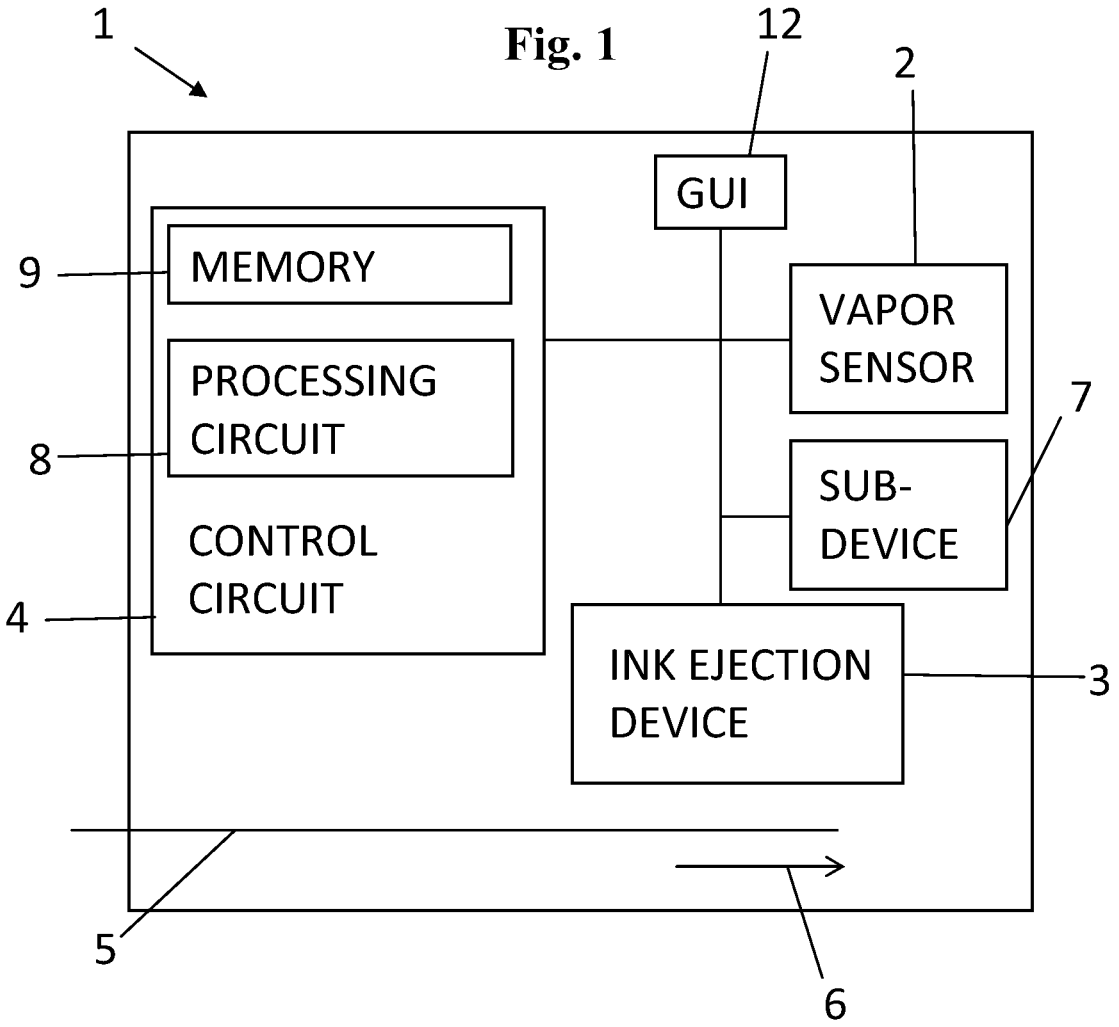
FIG. 1 illustrates an example of a printer.

FIG. 1 illustrates a diagrammatic example of a printer 1. The printer 1 includes a vapor sensor 2 and an ink transfer device 3. The printer 1 includes a control circuit 4, for example for instructing the ink transfer device 3. The control circuit 4 is connected to the vapor sensor 2 for receiving signals from the vapor sensor 2. An example print medium 5 and media advance direction 6 of the printer 1 are illustrated. The printer 1 includes at least one sub-device 7. For example, the sub-device 7 includes at least one of a radiation device, air control device and a media advance arrangement.

For example, the ink transfer device 3 includes a printhead. For example the ink transfer device 3 includes an ink ejection device for ejecting ink onto print media 5. For example, the ink transfer device 3 includes a scanning or page wide array printhead. For example, the ink transfer device 3 is fluidically connected or connectable to an ink supply. For example, the ink transfer device 3 is to transfer latex or water based ink. In other examples, the ink includes toner, dye, wax, etc., and/or for example UV-curable, pigment and/or latex ink or monomer-based ink.

For example, the control circuit 4 includes a processing circuit 8 and a memory 9. For example, the memory 9 includes a non-volatile memory circuit. For the purpose of this description the control circuit 4 can be part of the printer 1 or of the vapor sensor 2. For example the control circuit 4 is to control printer operations. For example, the control circuit 4 instructs the ink transfer device 3 and at least one of said printer sub-devices. For example, the control circuit 4 includes a digital and/or analogue application specific integrated circuit to control printer operations. For example the control circuit 4 is to control the ink transfer device 3 and the at least one sub-device 7.

The vapor sensor 2 is to detect a density or quantity of vapor that is released from ink transferred to the media 5 by the ink transfer device 3. For example, the vapor sensor 2 includes at least one of a humidity sensor, an optical sensor, such as a color or light sensor, a resistor, an acoustic wave sensor, or any other suitable type of sensor. For example vapor sensor detections are signaled to the control circuit 4 in analogue, digital, raw and/or coded form.

For example vapor includes visible or invisible droplets floating in the air, such as a fog. For example the vapor sensor 2 includes an optical sensor to detect the vapor. For example the vapor sensor 2 detects a vapor density. For example the detected vapor density approximately correlates with a relative amount of vapor that is present in the air. For example the detected density correlates with air humidity. For example density can be used as an indicator for a visibility of vapor. For example the density correlates with droplet sizes and vapor amounts in the air. For example, a higher density corresponds to one or both of a higher vapor droplet size and a higher vapor amount. In general it may be assumed that vapor density correlates with vapor visibility, it is noted that this assumption may be prone to some error margin. For example, a low amount of large droplets may be less visible than a high amount of small droplets or vice versa. It is noted that certain error margins are allowed while still facilitating appropriate levels of vapor control.

For example, the memory 9 stores a vapor density threshold. For example, the vapor density threshold corresponds to a predetermined maximum or minimum density of vapor. For example, the threshold is set to correlate to a certain user perceptible level of vapor. For example the memory 9 stores multiple thresholds, for example in a look-up table, that correspond to different levels of vapor. For example, different threshold are set to correlate to different levels of vapor. For example the threshold can be set at manufacturing stage and/or can be set or calibrated at an end user site, for example by service personnel, by an end user, or automatically by the printer. In certain examples the threshold is a range, or includes a margin, or time period. For example, the threshold may correspond to a certain signal or signal strength or code, wherein the signal, signal strength or code correlates with a detected vapor density.

For example, the control circuit 4 is to compare a detected vapor density as detected by the vapor sensor 2, with the threshold stored in the memory 9. For example, the control circuit 4 is to trigger a vapor control instruction if the detected vapor density exceeds the vapor density threshold. For example, the vapor threshold can be low so that the vapor control instruction is sent immediately when fog is detected. For example, the control circuit 4 is to trigger a vapor control instruction if the detected vapor density exceeds the vapor density threshold for a certain time. In an example where multiple different vapor density thresholds are stored, the vapor control instruction may be different depending on which threshold is exceeded.

For example, the control circuit 4 is to send the vapor control instruction to at least one of the ink transfer device 3 and the sub-device 7. For example the vapor control instruction is to control vapor by intervening in an output of at least one of said ink transfer device 3 and said sub-device 7. For example by temporarily decreasing ink transfer and media advance speed the vapor output can be controlled, for example so that it is less visible to an end user. For example, the level of change of the respective device output depends on which threshold is exceeded. In another example, the vapor control instruction is sent to a graphical user interface (GUI) 12, wherein an operator is advised or given the option to intervene when the vapor threshold is exceeded, through said interface 12.

For example the control circuit 4 is to continue printing at a different print speed, for example a lower print speed, if the vapor density threshold is exceeded. For example the control circuit 4 sends the vapor control instruction to the ink transfer device 3 and/or the media advance arrangement. For example, the control circuit 4 is to pause, decelerate or accelerate the print job for a certain amount of time in reaction to exceeding the threshold. In again other examples, when the printer vapor output exceeds the threshold, the vapor can be locally heated, the ink can be cured more rapidly, and/or fresh air is supplied and mixed with the vapor by the air control device. For example effects of one of these measures include a decrease in the visible vapor output or in certain cases prevention of moisture or stains on the printer 1 or surrounding objects.

In a further example, the vapor sensor 2 is to detect when the vapor density is beneath a second, low vapor threshold and the control circuit 4 is to resume printing at initial or higher speed if the detected vapor density is beneath said second threshold and/or the sub-devices 7 are re-set to their initial state.

For example high evaporation can occur at printing relatively high ink volumes at relatively high print speeds. An example of a printer 1 that can release high vapor amounts without vapor control is a page wide array large format printer. Another example is a large format latex printer. In certain examples a maximum print speed of the printer 1 is at least approximately 50 $m^2$/hour, or at least 80 $m^2$/hour, or at least 100 $m^2$/hour, for example at a density 1200 by 1200 dots per inch, 1 inch being approximately 2.54 centimeter, for example when printing on media 5 having a width of at least approximately 1 meter. In another example, a maximum print speed is at least approximately 80 or at least 150 $m^2$/hour, for example when printing on media having a width of at least approximately 2.5 meters.

Figure 2:
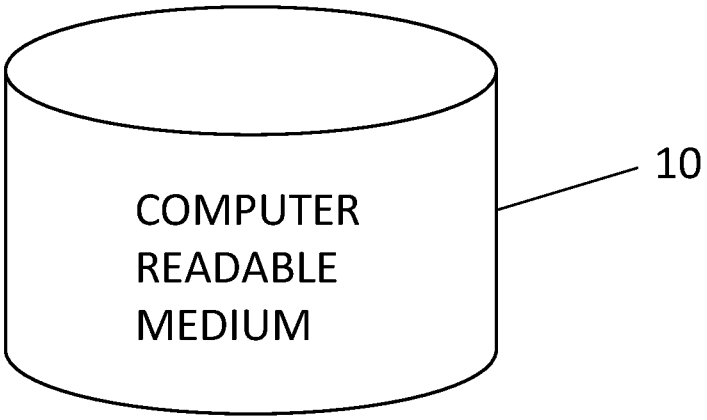
FIG. 2 illustrates an example of a computer readable medium.

FIG. 2 illustrates a diagrammatic example of a computer readable medium 10. For example the computer readable medium 10 includes a memory 9 or any suitable digital storage medium. In again further example, the computer readable medium 10 includes or is part of a network, internet, or cloud system. For example, the compute readable medium 10 can be part of the printer 1 and/or the vapor sensor 2, in the form of said memory 9. For example, the computer readable medium 10 stores the vapor density threshold. For example, the computer readable medium 10 stores a set of instructions for the control circuit 4. For example, the instructions include comparing an incoming signal that corresponds to a detected vapor density with at least one vapor density threshold. For example, the instructions include intervening in a printer operation if the detected vapor density exceeds the respective threshold. When installed in or connected to a printer 1 and/or vapor sensor 2, the computer readable medium 10 provides instructions for the control circuit 4 to control the visible vapor output. In further examples the printer operation that is to be intervened includes at least one of a print speed, ink curing by radiation, heating, supplying fresh air, and redirecting vapor flow.

Figure 3:
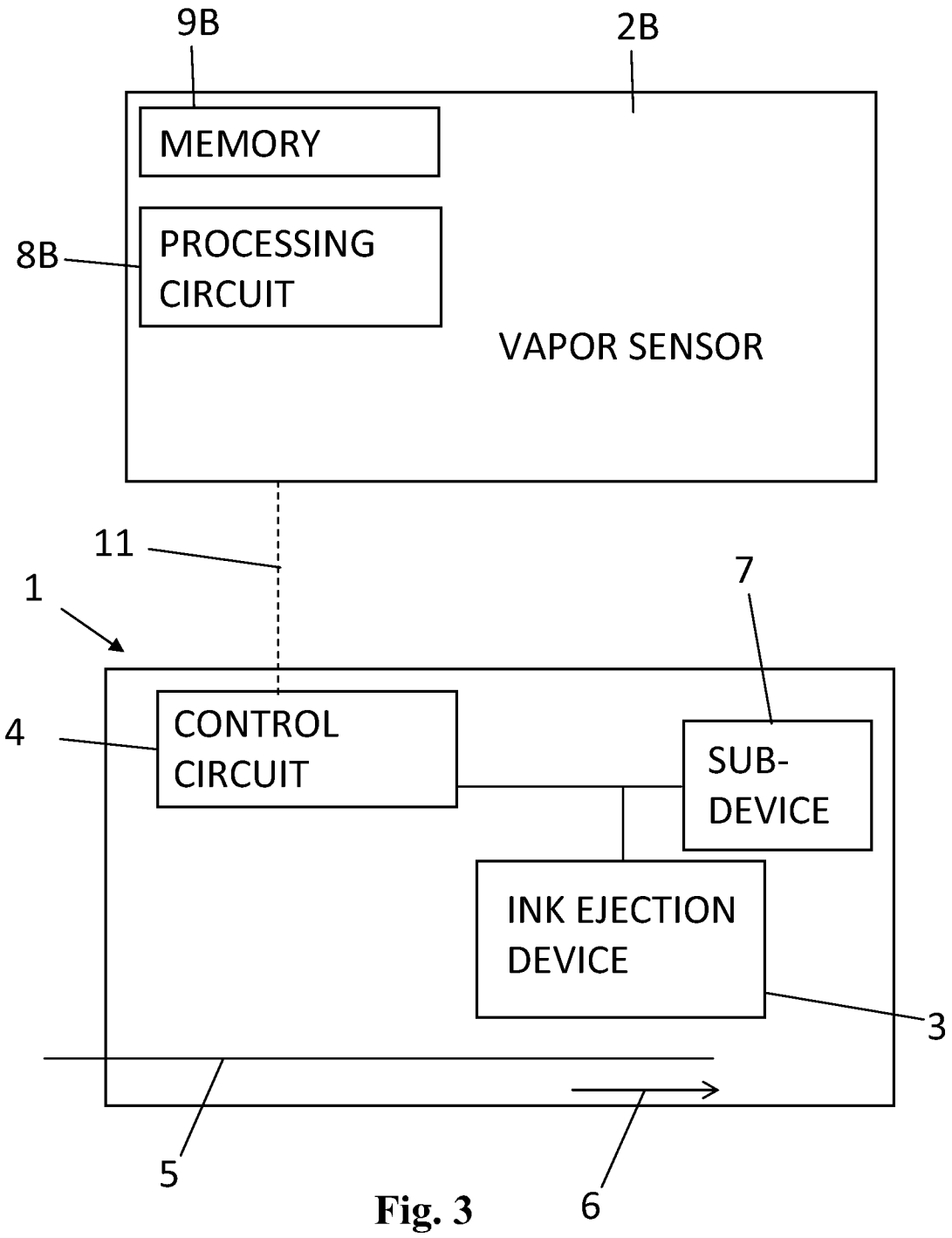
FIG. 3 illustrates an example of a printer and a vapor sensor.

FIG. 3 illustrates a further diagrammatic example of a printer 1 and vapor sensor 2B that is similar in function to FIG. 1. In the shown example, the printer 1 includes the control circuit 4, sub-device 7 and ink transfer device 3. Also the print medium 5 and media advance direction 6 are illustrated. For example a printer-vapor-sensor-interface 11 is provided. For example, the interface 11 includes at least one of a wired or wireless data connection. For example, the vapor sensor 2B is located outside of the printer 1, near the printer 1, or onto the printer 1, so as to detect vapor that exits the printer 1. In another example the vapor sensor 2B is located in the printer 1. For example, a memory 9B and processing circuit 8B are included in the vapor sensor 2B for processing the detections. For example the processing circuit 8B is to signal a vapor density to the control circuit 4 and the control circuit 4 is to compare that density with the threshold. In another example, the processing circuit is to compare a detected vapor density with a threshold stored in the sensor memory 9B and send a vapor density signal to the control circuit 4 when the threshold is exceeded. For example, the vapor sensor 2B is an accessory that can be mounted and/or connected to the printer 1 and/or control circuit 4 through a physically connected or wireless interface 11. For example, appropriate software, drivers, or interface can be installed in the printer 1 to allow signal exchange with the vapor sensor 2B. For example, one or more of such vapor sensors 2B can be mounted inside and outside of the printer 1.

Figure 4:
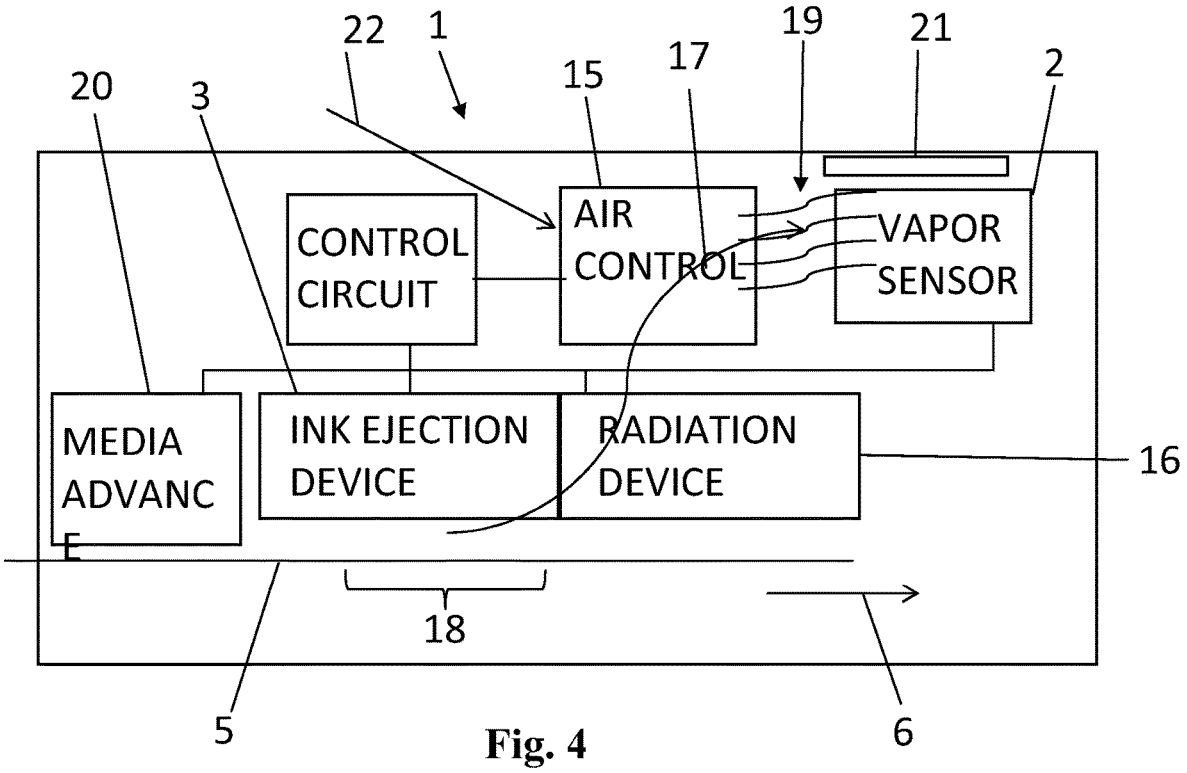
FIG. 4 illustrates another example of a printer.

FIG. 4 illustrates a diagrammatic example of a printer 1 including a vapor sensor 2, ink transfer device 3, a control circuit 4 and sub-devices 15, 16, 20. The illustrated sub-devices are an air control device 15, a radiation device 16 and a media advance arrangement 20. For example, the air control device 15 includes a fan or air pump. For example the radiation device 16 includes a heater.

For example, the air control device 15 is arranged to blow air and/or vapor, for example in a predetermined direction. For example, the air control device 15 includes a fan to provide fresh air 22 to the printer, and/or to regulate air flow and humidity. For example the air control device 15 has the effect of mixing the vapor with fresh air. For example the air control device 15 has the effect of dispersing the vapor. For example the air control device 15 redirects the vapor.

For example the radiation device 16 is to cure printed ink. For example the radiation device 16 includes a heater for heating the vapor/ink. For example the radiation device 16 emits UV radiation. For example the radiation device 16 includes a dryer.

For example close to the printed ink on the media 5 the vapor is still relatively hot so that the vapor particles are relatively small. Further away from the media 5 the vapor condenses into larger more visible droplets. For example, in the absence of vapor control measures, more visible droplets would exit the printer 1.

In an example, the vapor sensor 2 is placed in the printer, near a printer's extreme or a printer's outer contour to detect vapors that exit the printer. For example, near a printer's outer contour or extreme, or outside of the printer 1, the vapor can be in a relatively condensed state (FIG. 3), so that it can be detected when it includes relatively large droplets and for example better vapor control can be achieved. In other examples the vapor is detected in a non-visible range and/or relatively close to the media 5, a print zone 18, or the ink transfer device 3. For example, the vapor sensor 2 is located in a vapor path 17, for example between the print zone 18 and the air control device 15 or in a blow path 19 of the air control device 15. In further examples multiple vapor sensors 2 are placed at different strategic points within the printer 1, and/or on outer parts of the printer 1.

For example, the control circuit 4 is to intervene in at least one of the sub devices if the vapor density threshold is exceeded. For example the control circuit 4 is to adjust an air control device output if it is determined that the vapor density threshold is exceeded. For example, the control circuit 4 is to switch on or off the air control device 15, or to increase or decrease an output of the air control device 15. For example increasing a fan speed can have the effect that vapor that released from the printer 1 is mixed with clean air, so that exiting vapor becomes less visible.

For example, the control circuit 4 is to adjust the radiation device output if the vapor density threshold is exceeded. For example, when detecting high vapor output, the control circuit 4 is to switch on, switch off, increase or decrease a radiation output of the radiation device 16. For example by decreasing a heat or UV radiation the printed ink is cured more slowly so that ink evaporation is decreased. In again further examples a radiation device 16 such as a heater is provided to heat the vapor so that droplets become smaller or reach a gas state. This may also reduce condensation or a visible vapor amount outside of the printer 1.

For example, the control circuit 4 is to control the air control device 15 and/or the radiation device 16 to condense vapor inside of the printer 1, to prevent as much as possible visible droplets outside of the printer 1. For example vapor particles are heated and ventilated to prevent fog formation. For example vapor particles in the printer 1 are directed to a condensing system that collects the condensed liquids for example in a collection bottle or container, herewith referred to as condensation part 21. The illustrated example printer 1 includes such condensation part 21. For example, the condensation part 21 is arranged to receive the vapor. For example, the condensation part 21 is arranged in a blow path of the air control device 15. For example the condensation part 21 is exchangeable and/or disposable. For example the condensation part 21 includes a heater or heat exchange feature.

In an example, the control circuit 4 is to intervene while executing a print job. For example if the control circuit 4 detects that the vapor density threshold is exceeded during execution of a print job, the control circuit 4 adjusts an output in one of the ink transfer device 3 or the sub-devices 15, 16, 20 while continuing with execution of the print job. For example, the ink transfer speed and media advance speed is adjusted during the print job to control vapor output, and/or one of the sub-devices 15, 16, 20 is instructed so as to control the vapor output. Herein the ink transfer speed can be defined as an amount of ink that is transferred per time unit. For example, once the vapor density is determined to be again below said threshold, or a below second different threshold, the print job is continued at initial speed and/or initial sub-device output.

Figure 5:
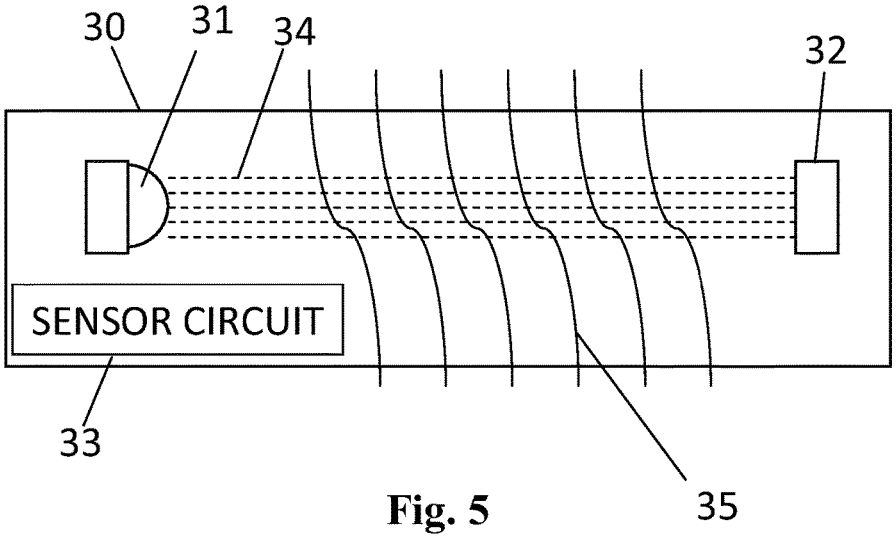
FIG. 5 illustrates an example of a vapor sensor.

In the diagrammatic example of FIG. 5 the vapor sensor is an optical sensor 30. For example the optical sensor 30 includes a light emitter 31, a light detector (or photo sensor) 32. For example, as a result of changing vapor amounts 35 in the air, air opacity changes. The changed air opacity can be detected by the optical sensor 30. For example, the light emitter 31 emits light 34 in the visible or invisible wavelength range so that the light 34 is at least partly reflected and/or dispersed by the vapor droplets that pass between the light emitter 31 and light detector 32, therewith allowing for vapor detection. Tests have shown that certain example optical sensors 30 can be implemented for vapor detection. Certain example optical sensors 30 detect high vapor amounts relatively reliably and cost efficiently.

For example, the light emitter 31 includes a light emitting diode (LED) or laser of a suitable type. For example the light emitter 31 is arranged to emit in one of an infrared, red, blue or visible wavelength range. In one example the light emitter includes a wavelength that is reflected by specific chemical compounds present in the vapor, such as, for example, 2-Pyrrolidinone and 2-Methyl-1,3-propanediol, which are present in latex ink. In an example, the light emitter 31 emits at a wavelength of between 400 and 1000 nanometers, or for example between 200 and 2000 nanometers. For example the sensitivity of the light detector 32 is calibrated by modifying amplifier parameters, for example to be compatible with the light emitter's wavelength range.

For example a sensor circuit 33 is to correlate a change in detected light intensity with a change in vapor emission. In a not illustrated example the detection circuit 33 is part of the previously addressed control circuit 4. For example a signal strength of the light detector 32 is correlated with vapor density according to a predetermined signal-vapor correlation algorithm. For example, light intensity strength of the light emitter 31 is calibrated in time to compensate for degradation of the light emitter 31 in time. For example light detector amplifier parameters are calibrated over time to compensate for said degradation. For example the optical sensor 30 runs regular self-tests to auto-calibrate.

In a further example the sensor circuit 33 is to calibrate itself before starting vapor detection, for example to compensate for an initial state of the ambient light. For example, this calibration is done when the printer is cold. In a further example, the vapor sensor 30 is located in the printer 1 at a relatively dark and/or covered location, to avoid influences of ambient light. For example, said calibration for ambient light and said calibration for degradation are the same calibration.

In one example, the sensor circuit 33 continuously sends signals to the control circuit 4 that correspond to the vapor density detections. In another example the sensor circuit 33 sends said vapor density signals only during time intervals when the at least one threshold is exceeded. In again further examples vapor density signals are continuously compared to multiple thresholds. The control circuit 4 is to intervene in one of the ink transfer device 3 or sub-devices 7, 15, 16, 20 when the threshold is exceeded in order to control printer vapor output. For example the level of intervention may depend on the measured vapor density level.

Figure 6:
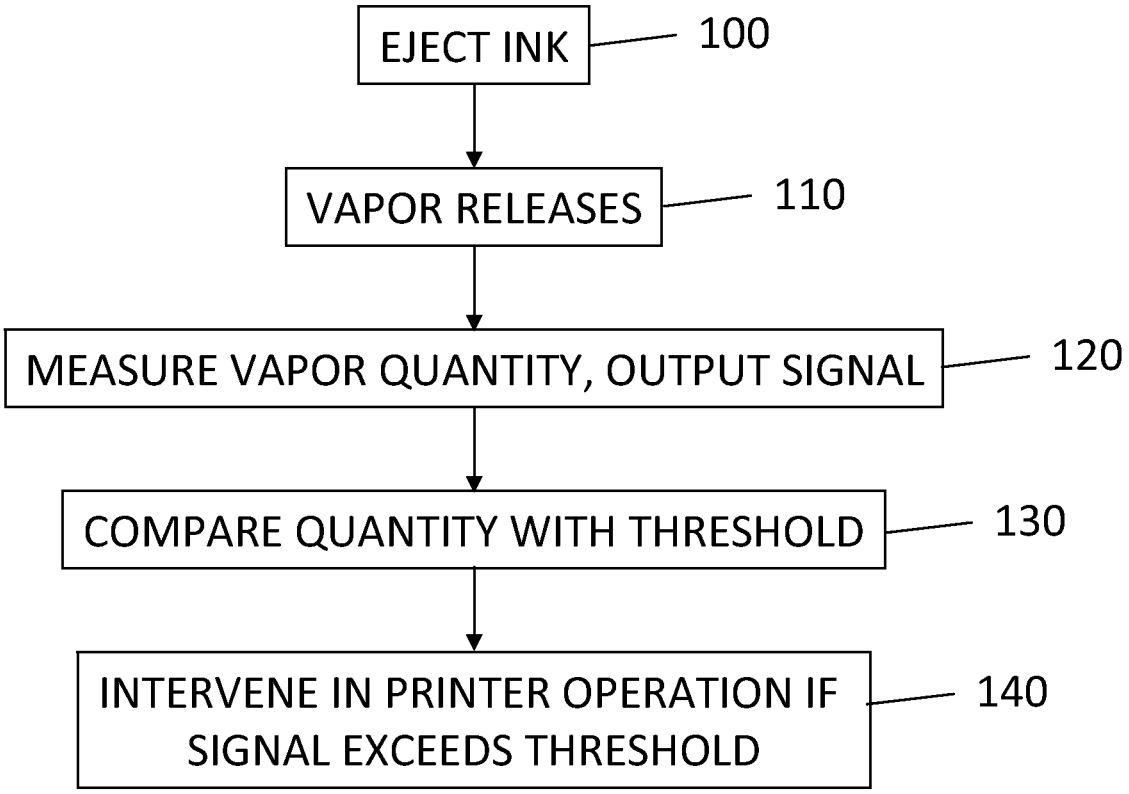
FIG. 6 illustrates a flow chart of an example of a method of printer vapor control.

FIG. 6 illustrates a flow chart of an example of a method of printer vapor control. For example, the method includes transferring ink (100), from the ink transfer device 3 to print media 5, whereby vapor is released (110). For example the method includes detecting a density of the vapor (120), for example using the vapor sensor 2, 30 and outputting a vapor density indication signal. For example, the method includes comparing the detected signal with a predetermined threshold (130) stored on the memory 8. For example the method includes intervening in a printer operation if the detected signal exceeds said threshold (140).

Figure 7:
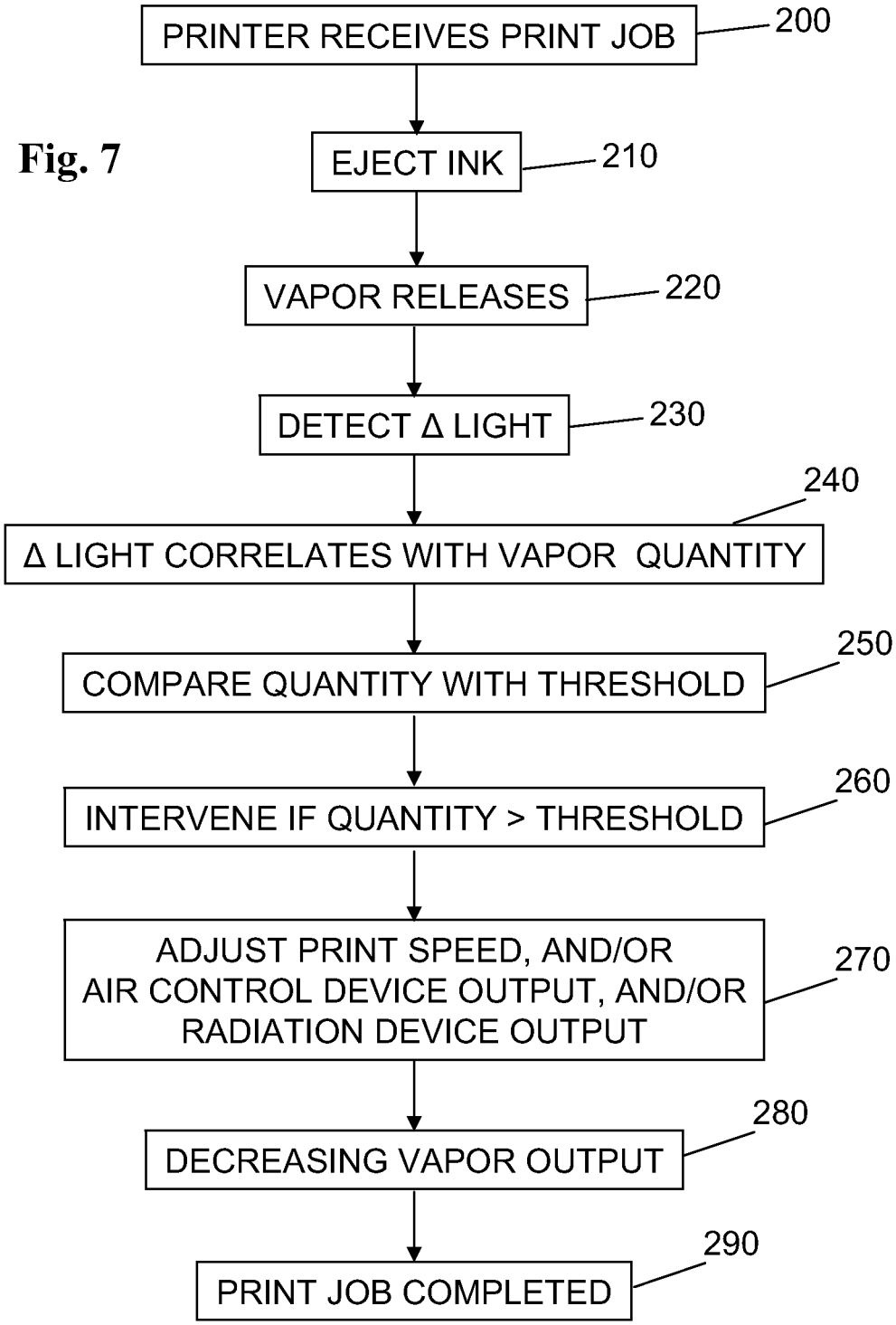
FIG. 7 illustrates a flow chart of another example of a method of printer vapor control.

FIG. 7 illustrates a flow chart of another example of a method of printer vapor control. For example, the printer 1 receives a print job (200). For example, the method includes transferring ink (210) onto media 5 to print the print job, whereby vapor is released (220).

For example the method includes emitting light, detecting the light with a light detector 32 (230), wherein a detected light intensity correlates with a vapor density (240). For example, the method includes comparing the detected signal with a predetermined threshold (250) stored on the memory 8. For example the method includes intervening in a printer operation if the detected vapor density exceeds said threshold (260). For example said intervening includes at least one of (i) adjusting a print speed, (ii) adjusting an air control device output, and (iii) adjusting a radiation device output (270). For example said adjusting corresponds to one of switching on/off a respective device 3, 15, 16, 20 or increasing or decreasing a respective output of the respective device 3, 15, 16, 20. For example the intervening has the effect of decreasing the printer's vapor output (280). For example, a memory 8 stores multiple of said thresholds and depending on which threshold is exceeded the output change of the respective device 3, 15, 16, 20 may be more drastic.

For example the method includes continuing without interruption the ink transfer to the media, while appropriately adapting the device output, until completion of the initiated print job (290).

The above description is not intended to be exhaustive or to limit this disclosure to the examples disclosed. Other variations to the disclosed examples can be understood and effected by those of ordinary skill in the art from a study of the drawings, the disclosure, and the claims. The indefinite article "a" or "an" does not exclude a plurality, while a reference to a certain number of elements does not exclude the possibility of having more or less elements. A single unit may fulfil the functions of several items recited in the disclosure, and vice versa several items may fulfil the function of one unit. Multiple alternatives, equivalents, variations and combinations may be made without departing from the scope of this disclosure.

What is claimed is:

1. A printer comprising an ink transfer device, a vapor sensor to detect a density of vapor that is released from transferred ink, the vapor sensor disposed on an exterior of the printer, a memory storing multiple vapor density thresholds in a look-up table, and a control circuit to trigger a vapor control instruction to reduce vapor production when a detected vapor density exceeds one of the thresholds, wherein the control instruction is different for different thresholds.

2. The printer of claim 1, wherein the sensor is placed so as to detect vapor that exits the printer.

3. The printer of claim 1, comprising at an ultraviolet (UV) radiation device, wherein the control circuit is to intervene in at least one of these devices when one of the vapor density thresholds is exceeded.

4. The printer of claim 1, wherein the control circuit is to continue printing at a different print speed when one of the vapor density thresholds is exceeded.

5. The printer of claim 1, having a maximum print speed of at least 50 square meters per hour.

6. The printer of claim 1, wherein the control circuit is to intervene while executing a print job.

7. The printer of claim 1, comprising an exchangeable condensation part for receiving condensed droplets.

8. The printer of claim 1, wherein the sensor includes an optical sensor to correlate a change in detected light intensity with a change in vapor emission.

9. The printer of claim 1, wherein the threshold is set to a level of vapor density that is perceptible to a user.

10. The printer of claim 1, further comprising a graphical user interface, wherein the control instruction comprises presenting an option on the graphical user interface to intervene in printer operation when the density of vapor exceeds the threshold.

11. The printer of claim 1, wherein the vapor sensor comprises a light emitter having a wavelength that is reflected by chemical compounds present in the vapor released from transferred ink.

12. The printer of claim 1, wherein the control instruction adjusts output of a radiation device in the primer to reduce vapor production.

* * * * *